United States Patent [19]

Tolleson

[11] 3,951,079

[45] Apr. 20, 1976

[54] TIERED SPACE SAVER FOR DINING TABLE AND THE LIKE

[76] Inventor: Morris L. Tolleson, 1224 W. Hammond, Fort Worth, Tex. 76115

[22] Filed: May 14, 1975

[21] Appl. No.: 577,223

Related U.S. Application Data

[63] Continuation-in-part of Ser. No. 502,301, Aug. 30, 1974, abandoned.

[52] U.S. Cl. ..... 108/94; 224/48 R; 211/128

[51] Int. Cl.[2] ..... A47B 57/00

[58] Field of Search ..... 224/48 R, 48 P, 48 B; 211/129, 14, 128, 131, 133; 206/65, 45; 108/91, 94, 95, 96

[56] References Cited

UNITED STATES PATENTS 1,703,340 2/1929 Grennan ..... 211/129

3,224,655 12/1965 Buchanan et al. ..... 224/48

FOREIGN PATENTS OR APPLICATIONS 19,485 8/1913 United Kingdom ..... 211/128

*Primary Examiner*—Robert J. Spar
*Assistant Examiner*—Kenneth Noland

[57] ABSTRACT

A tiered space saver or table top including a stand having a base rotatably supported therein and on which there are supported four independent circular trays stacked one atop the other in vertically spaced apart positions and of ascendingly decreasing respective diameters, each tray being independently rotatable about its central axis, and a handle affixed to the top tray.

5 Claims, 6 Drawing Figures

Fig.5
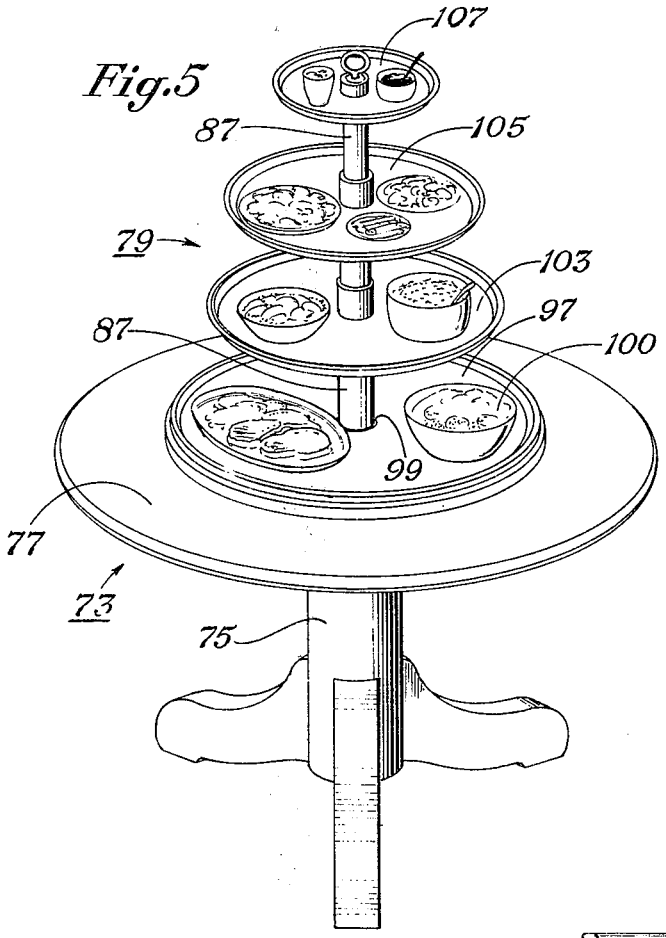
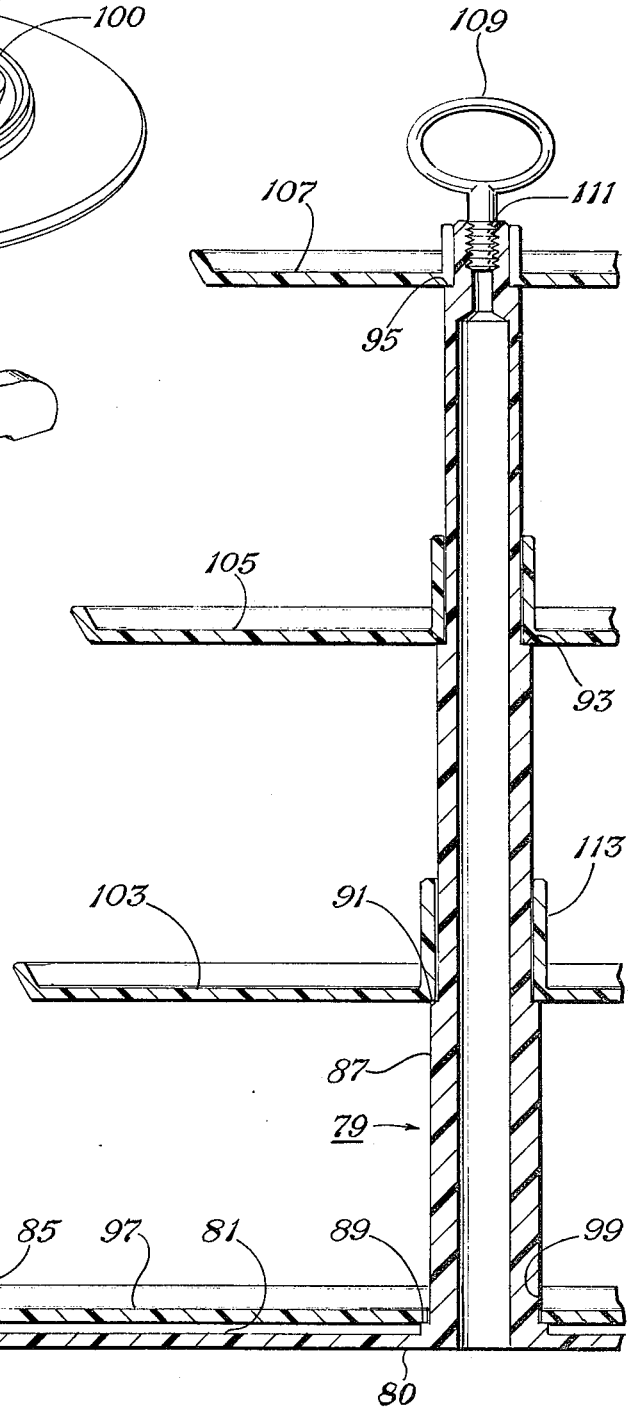
Fig.6

TIERED SPACE SAVER FOR DINING TABLE AND THE LIKE

CROSS REFERENCE TO RELATED APPLICATIONS

This is a continuation-in-part of my copending application Ser. No. 502,301 filed Aug. 30, 1974, abandoned as of the filing date of this application.

BACKGROUND OF THE INVENTION

1. Field of the Invention

This invention relates generally to space saving devices and more particularly to a novel and improved tiered spaced saver or table top consisting of a plurality of independently revolving trays, or table tops, disposed in vertically spaced apart stacked relationship.

2. Description of the Prior Art

In view of the constant clutter about the home and office individuals are constantly seeking space saving devices for maximizing available storage space. A particular problem concerns dining tables, where the number of dishes served, such as during holiday meals, may exceed the space available, particularly with more diners than normal. While it has been known in the prior art to provide many types and varieties of such space saving devices, all of such devices suffer from one or more disadvantages as to being overly expensive and complex to manufacture, require routine maintenance, are difficult to wash and maintain in a clean manner, and otherwise are nor completely satisfactory to prospective purchasers and thus have not met with widespread commercial success.

SUMMARY OF THE INVENTION

The present invention recognizes the need for space saving devices and, upon recognizing the deficiencies and disadvantages of presently available space saving devices, provides a novel solution thereto in the form of a tiered space saver or table top consisting of a plurality of various diameter trays stacked in vertical spaced apart relationship with each tray being independently rotatable to provide ease of access to the contents of any tray.

It is a feature of the present invention to provide a tiered space saver or table top of size and stability to place food dishes upon to provide more space at a dining table.

A further feature of the present invention provides a tiered space saver or table top which is relatively simple in its construction and which therefore may be readily manufactured at a relatively low cost and by simple manufacturing methods.

Still a further feature of the present invention provides a tiered space saver or table top which is possessed of few parts and which therefore is unlikely to get out of order.

Yet still a further feature of the present invention provides a tiered space saver or table top which is easy to use and reliable and efficient in operation.

Still yet a further feature of the present invention provides a tiered space saver or table top which is aesthetically pleasing and refined in appearance.

Yet still a further feature of the present invention provides a tiered space saver or table top which can be retailed at a sufficiently low price to encourage widespread use thereof.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same:

FIG. 5 is a perspective view of an alternate embodiment of a tiered space saver or table top mounted on a dining table.

FIG. 6 is a vertical cross-sectional view of the tiered space saver or table top of FIG. 5.

DESCRIPTION OF THE PREFERRED EMBODIMENT

Figure 1:
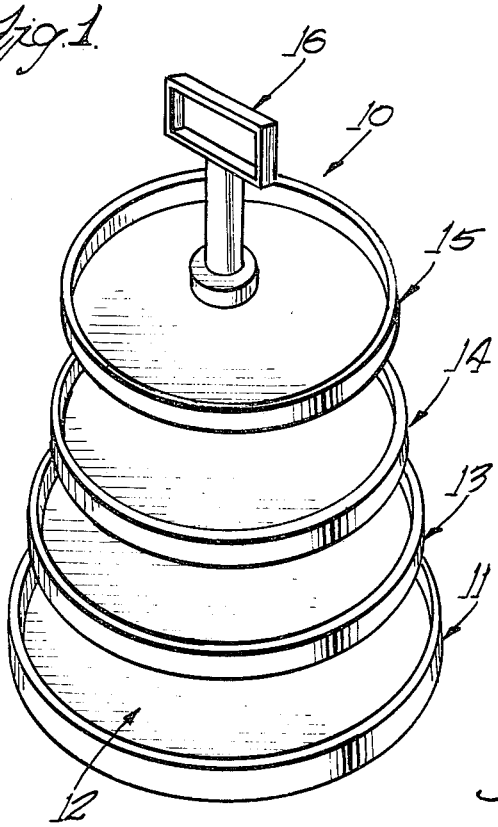
FIG. 1 is a top perspective view of the tiered space saver or table top of the present invention.
Figure 2:
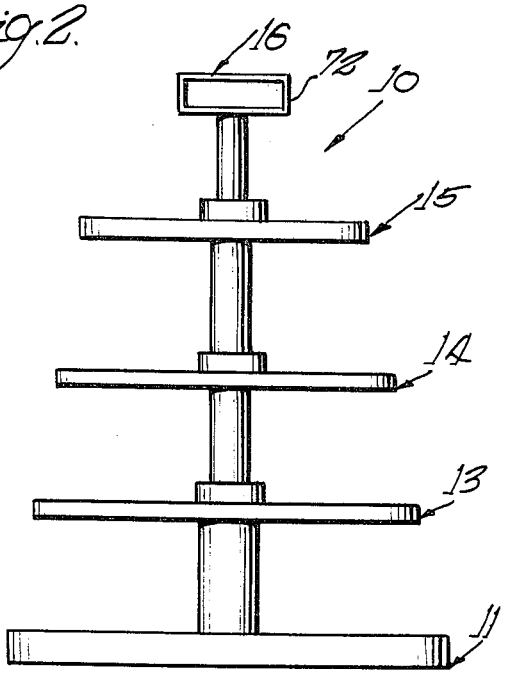
FIG. 2 is a front elevational view of the tiered space saver or table top of FIG. 1.
Figure 3:
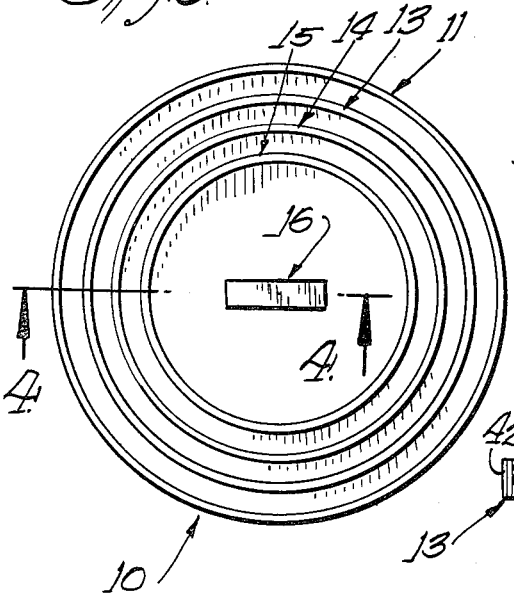
FIG. 3 is a top plan view of the tiered space saver or table top of the present invention.
Figure 4:
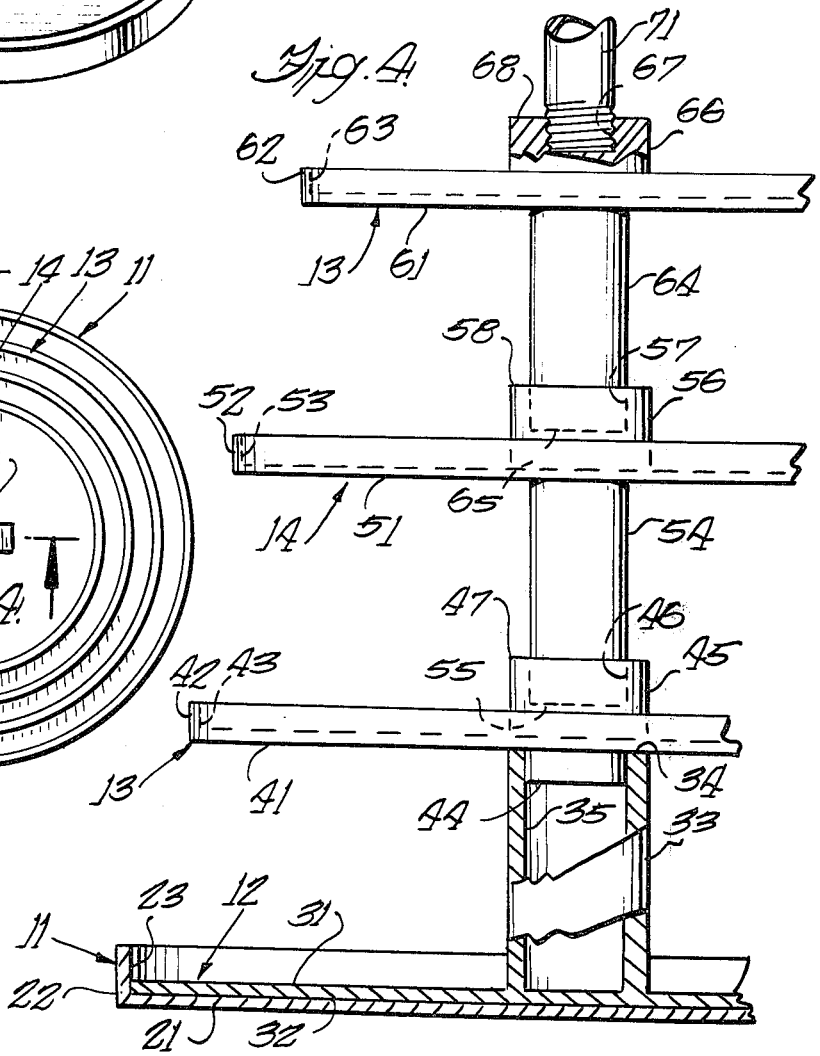
FIG. 4 is an enlarged fragmentary cross-sectional view taken along line 4—4 of FIG. 3.

Referring now to the drawings in detail there is illustrated a preferred form of a tiered space saver or table top constructed in accordance with the principles of the present invention and which is designated generally in its entirety by the reference numeral 10 and which is comprised of a stand 11, a base 12, a plurality of trays 13, 14 and 15, and a handle 16.

The tiered space saver table top 10 may be manufactured out of metal, wood, hard rubber, plastic, or any other suitable satisfactory material providing an aesthetically pleasing and refined appearance, with the preferred embodiment being manufactured of a high density plastic material such as polyethylene, polystyrene, and the like which may be provided in a variety of colors appealing to prospective purchasers.

The stand 11 is of a hollow open topped closed bottom cylindrical configuration having a bottom 21 and depending surrounding cylindrical side walls 22 extending upwardly therefrom and defining a cylindrical recess 23 interiorly thereof.

The base 12 is of a flat circular disc shaped configuration having a top surface 31, a bottom surface 32, and an open topped cylindrical shaft 33 disposed concentric therewith and extending upwardly from the top surface thereof and terminating at an open top end 34 defining a passageway 35 interiorly thereof. The base 12 rests in recess 23 on bottom 21 concentric therewith and is rotatable therein in either direction about its central axis.

Each of the circular trays 13–15 are of an identical structure except for the dimensions thereof in that tray 15 is of a lesser diameter than tray 14 which, in turn, is of a lesser diameter than tray 13, which, in turn, is of a lesser diameter than the base 12.

Tray 13 is of a circular configuration having a flat disc shaped bottom surface 41 with depending vertically extending cylindrical side walls 42 extending upwardly from the peripheral edges thereof and defining interiorly thereof an open topped interior compartment 43. Disposed concentric with the bottom 41 and extending downwardly therefrom is a cylindrical boss 44 of a diameter less than the diameter of passageway 35 and is adapted to be received in the top end of the passageway with the top end 34 of the sleeve 33 restingly engaged against the bottom 41 about the boss 44 to rotatably support tray 13 thereon for rotation about its central axis. Mounted concentric with bottom 41 in compartment 43 and projecting axially vertically upwardly therefrom is collar member 45 of a cylindrical configuration provided with a cylindrical bore 46 centrally thereof and opening out of the top 47 thereof.

Tray 14 is of a circular configuration having flat disc shaped bottom 51 with depending vertically upwardly extending cylindrical side walls 52 defining interiorly thereof compartment 53. A cylindrical supporting shaft 54 is disposed concentric with bottom 51 and extends vertically downwardly therefrom terminating at bottom end 55, the shaft being of a diameter to be received in recess or socket 46 in a snug but rotative manner. A cylindrical collar member 56 is disposed concentric of bottom 51 in compartment 53 and extends vertically upwardly therefrom and has defined therein a cylindrical socket 57 opening out of the top end 58 thereof.

Tray 15 is of a circular configuration having flat disc shaped bottom 61, cylindrical depending upwardly extending side walls 62, a cylindrical compartment 63 defined therein, a supporting shaft 64 of a cylindrical configuration disposed concentric with the bottom 61 projecting vertically downwardly therefrom and terminating in bottom end 65 and being of a diameter to be received in socket 57 and rotatable relative thereof, and a collar member 66 formed concentric in compartment 63 and projecting vertically upwardly therefrom and having an interiorly threaded socket 67 opening out of the top end 68 thereof.

The handle 16 includes an elongated cylindrical shaft 71 threaded at its bottom end to be threadedly received in socket 67, and terminating in its upper end in a closed loop 72 of a rectangular frame configuration adapted to be readily grasped in an individual's hand.

There is thus provided a tiered space saving device wherein each of the trays are independently rotatable relative to each other, and wherein the base is independently rotatable in the stand to provide each of access to items stored thereon.

FIG. 5 shows an alternate embodiment of a tiered table top for a dining table. A conventional table 73 is shown having a pedestal or supporting structure 75 and top 77, which is circular in the preferred embodiment. The table 73 may be of any shape and size. Conventional sizes include 36, 42 and 48 inch widths. A tiered table top 79 is carried by the table 73, and the tiered table top 79 will be sized appropriately, allowing eating space peripherally around the tiered table top 79.

The tiered table top 79 has a stand 80 mounted frictionally on the top of the table. The lower surface of the stand 80 may contain a rubber or textured layer (not shown) to prevent slippage about the table. Stand 80 comprises a flat circular disc 81 having a short cylindrical side wall 83 about its perimeter. A smooth inner step 85 of lesser height than the outer portion of side wall 83 forms the inner portion of the side wall. Step 85 is in the shape of a relatively thin annular ring and serves as a smooth bearing surface for a base tray, to be described below. A nylon bushing (not shown) may be placed on the step 85 to reduce friction is desired.

A center shaft 87 rises vertically from the stand 80. The shaft 87 is rigidly fastened to the stand so that it is nonrotatable, and may be integrally formed with the stand as indicated in the drawing. The shaft 87 is ascendingly reduced in diameter at several selected points, thereby forming shoulders 89, 91, 93 and 95. The shoulders serve as a smooth bearing surface for respective trays or table tops, to be described hereinafter. Nylon bushings or other bushings (not shown) may be placed on the shoulders to further reduce friction if desired.

A base tray, or base table top, 97 rests upon the step 85 of the side wall and the lowermost shoulder 89, which are of equal heighth. The smoothness of the bearing surfaces allow the base tray to be freely rotatable about shaft 87. A center aperture 99 allows the base tray to be inserted over the shaft 87 and is slightly larger than the shaft diameter at that point. The perimeter of the base tray 97 has a curved lip 101 to prevent objects from sliding off, and the upper surface is flat for the placement of food dishes, indicated by numeral 100. The lip 101 protrudes higher than the side wall 83 so that it may be gripped, for example, to rotate the base tray.

The size of the base tray 97 may vary depending on the size of table 73. There should be sufficient space surrounding base tray 97 for the placement of plates and glasses for the diners. For example, the base tray 97 may be 20 inches in diameter for a 42 inch diameter circular table 73, thereby allowing 11 inches for the placement of plates. Diameter for the base tray 97 may range from 16 to 24 inches.

Directly above the base tray 97 at selected intervals, shown as three in the embodiment, are a plurality of upper trays, or additional table tops, 103, 105, 107, positioned respectively over shoulders 91, 93, 95. Each upper tray is similar to each other and to the base tray 97, in that each contains a lip at the perimeter and an aperture at the center. As illustrated, the trays have ascendingly monotonically decreasing diameters, peripheral and central. Expressed otherwise, each succcessively higher tray is smaller in diameter and has a smaller center aperture size than the adjacent lower tray. Each center aperture is of slightly larger diameter than the shoulder upon which the particular tray is designed to be carried to reduce friction during rotation. Each tray will fit only upon its respective shoulder. For example, upper tray 103 will fit only upon shoulder 91, being too small to pass to shoulder 89, and too large to remain on shoulders 93 or 95. The upper surfaces of the upper trays are flat for the placement of food dishes.

Each upper tray or additional table top 103, 105, 107 also contains a tubular member or boss 113 rigidly attached or formed to the tray and extending upwardly from center aperture 91. Boss 113 fits closely over shaft 79 and extends upwardly a suffficient distance to prevent tipping of the tray if eccentrically loaded. The heighth of boss 113 may be in the range from 1 to 3 inches.

The upper trays 103, 105, 107 are spaced apart from each other a distance sufficient for most food dishes to be placed thereon. which may be in the range from 5 to 8 inches, preferably 6 inches. The diameters of the upper trays may vary in diameter; tray 103 being in the range from 12 to 20 inches. preferably 16 inches. Tray 105 may be from 8 to 16 inches, preferably 12 inches, while the tray 107, the uppermost may be from 6 to 10 inches, preferably 8 inches.

A handle 109 is rigidly mounted to the top of shaft 87, as by threads 111. The handle 109 is of a configuration, shown as a circular loop, that is comfortable to grip while lifting the stand.

The tiered table top 79 is utilized by first placing the stand 80 and trays securely on the table 73. Food dishes may be placed on the trays, with the heavier dishes on the base tray.

It may be readily seen that an invention having significant advantages has been provided. Each tray is independently rotatable, and in the second embodiment, rotation of one will not affect the others. The base tray in the second embodiment is easily rotatable as well, yet will withstand heavy food dishes without tipping since the step 85 directly bears any tilting forces. Construction is simple, yet an effective surface for rotation is provided.

While a rubber or textured layer on the bottom of stand 80 has been described for preventing slippage on the table, a plurality of suction cups may be employed, if desired. Suitable furniture oil or the like can be employed to prevent marring fine furniture and the suction cups prevent any chance of tipping; even when the table top is eccentrically loaded and inadvertently hit by a guest taking or replacing a dish or the like.

It is to be understood that the two forms of this invention herewith shown and described are to be taken as preferred examples of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

I claim:

1. A combination comprising a table having a top carried by a supporting structure and carrying a tiered table top; said tiered table top including:

a stand carried nonrotatably on the top of the table; being of circular configuration; and having a side wall at its perimeter;

a vertical shaft fixed to the center of the stand, said shaft having a plurality of shoulders at selected intervals, each defining a portion of diameter less than the succeeding lower one;

a circular base tray having a flat upper surface for the placement of food dishes, said base tray having an aperture at its center for the insertion of the shaft, said base tray being rotatably carried by the lowermost shoulder and the side wall of the stand;

a plurality of upper trays having flat upper surfaces for the placement of food dishes, each upper tray having an aperture at its center for the insertion of the shaft, each aperture being of a lesser diameter than the aperture of the succeeding next lower tray, and each upper tray being individually rotatable on the respective shoulders whereby rotation of one tray will not rotate another tray;

a plurality of tubular members each rigidly connected to an upper tray and extending upwardly therefrom, each tubular member being of a size to closely fit about the shaft to prevent tipping if the tray is eccentrically loaded.

2. The tiered table top according to claim 1 wherein the upper trays are circular, with each tray being of ascendingly monotonically decreasing diameter, peripheral and central, and each upper tray containing a lip as its perimeter.

3. The tiered table top according to claim 1 wherein the side wall of the stand includes a cylindrical portion and an inner step of lesser heighth than the side wall to provide a bearing surface for the base tray.

4. The tiered table top according to claim 1, additionally comprising a handle affixed to the top of the shaft for carrying the stand.

5. The tiered table top according to claim 1 wherein the base tray is of a diameter equal to the width of a conventional dining table less a distance substantially equal to the diameter of conventional dining plates in order to allow eating space peripherally around the tiered table top.

* * * * *